US008485922B2

(12) United States Patent
Liao

(10) Patent No.: US 8,485,922 B2
(45) Date of Patent: Jul. 16, 2013

(54) BALL HOLDER AND BASE PLATE FIXING STRUCTURE OF BATTING PRACTICE APPARATUS

(76) Inventor: Grace Liao, Taipei (TW)

( * ) Notice: Subject to any disclaimer, the term of this patent is extended or adjusted under 35 U.S.C. 154(b) by 236 days.

(21) Appl. No.: 13/086,601

(22) Filed: Apr. 14, 2011

(65) Prior Publication Data

US 2012/0264548 A1 Oct. 18, 2012

(51) Int. Cl.
*A63B 69/00* (2006.01)
*A63B 71/00* (2006.01)

(52) U.S. Cl.
USPC ..... 473/417; 473/422

(58) Field of Classification Search
USPC ..... 473/417, 387, 388, 399, 419, 422, 473/451, 591; D21/720
See application file for complete search history.

(56) References Cited

U.S. PATENT DOCUMENTS 1,616,236 A * 2/1927 Schacht ..... 273/336
3,421,473 A * 1/1969 Weichenrieder ..... 116/63 R
4,136,869 A * 1/1979 Tassone ..... 473/417
4,364,563 A * 12/1982 Stafford ..... 473/417
5,492,323 A * 2/1996 Lee ..... 473/278
5,916,045 A * 6/1999 Busch ..... 473/417
2002/0073912 A1* 6/2002 Kuo ..... 116/63 P
2009/0312123 A1* 12/2009 Liao ..... 473/417
2012/0264548 A1* 10/2012 Liao ..... 473/417

* cited by examiner

*Primary Examiner* — Gene Kim
*Assistant Examiner* — M Chambers
(74) *Attorney, Agent, or Firm* — Rabin & Berdo, P.C.

(57) ABSTRACT

A ball holder and base plate fixing structure for batting practice apparatus is provided, including a sheath tube and a base plate. The sheath tube includes a first segment and a second segment, connected to each other. The first segment has a round tube shape for providing placing said ball holder. The second segment has a trumpet shape, said sheath tube having compressible resilience. The base plate has an installation hole. When assembled, the second segment of the sheath tube is compressed into the installation hole for tight engagement so as to fix the sheath tube to the base plate. In this manner, the ball holder is sheathed into the sheath tube and fixed to base plate. During batting practice, the resilience of sheath tube allows the ball holder to swing and twist on impact to absorb and annihilate some of the impact. After batting, the resilience of sheath tube can restore the ball holder to original position.

12 Claims, 7 Drawing Sheets

BALL HOLDER AND BASE PLATE FIXING STRUCTURE OF BATTING PRACTICE APPARATUS

FIELD OF THE INVENTION

The present invention generally relates to a batting practice apparatus, and more specifically to a ball holder and based plate fixing structure of a batting practice apparatus.

BACKGROUND OF THE INVENTION

FIG. 7 shows a schematic exploded view of a conventional batting practice apparatus, including an installation hole 61 on a base plate 60, and a ball holder 62 engaged to base plate 60 via a connecting set. The connecting set includes a first connecting element 63, a second connecting element 64 and a locking element 65. For assembly, first connecting element 63 partially extends through installation hole 61 to the top surface of base plate 60, second connecting element 64 is screwed tightly to the segment of first connecting element 63 extending above base plate 60, and then ball holder 62 is inserted to second connecting element 64. Finally, locking element 65 is crewed tightly to second connecting element 64. In this manner, ball holder 62 is foxed to base plate 60. However, the above structure has the following disadvantages:

1. The ball holder requires a connecting set having a plurality of connecting elements to engage to the base plate. The assembly and the disassembly are both inconvenient. In addition, the more elements the structure has, the higher the manufacturing cost is.
2. The batting practice apparatus using the conventional structure only has the top segment close to the tip of the ball holder made of resilient rubber material to annihilate the force acted on the ball holder during batting practice. However, the strength of the above structure is insufficient, and therefore, a heavy weight object is usually added to the base plate to using nails to temporarily fix the base plate to the ground during batting practice to prevent the batting practice apparatus from tipping over.

Therefore, it is imperative to devise a ball holder and base fix structure of batting practice apparatus to overcome the disadvantages in the conventional structures.

SUMMARY OF THE INVENTION

The primary object of the present invention is to provide a ball holder and base plate fixing structure that is easy to assemble by using a single element structure to engage the ball holder to the base plate. The novel structure can overcome the disadvantages of the conventional structure using a plurality of connecting elements to engage the ball holder and the base plate, such as, inconvenient operation and high manufacturing cost.

Another object of the present invention is to provide a ball holder and base plate fixing structure with appropriate strength and resilience. The present invention mainly uses a sheath tube that is compressible and resilient. The sheath tube has a trumpet shape end to be uniformly compressed into an installation hole of a smaller diameter on the base plate during assembly so that the sheath tube will be tightly fixed to the base plate. The uniform compression can improve the strength of the sheath tube. However, the sheath tube still maintains appropriate resilience. When assembled, the ball holder is inserted into the sheath tube. With this novel structure, the sheath tube connected to the ball holder can bend and swing slightly to annihilate the force acted upon during the batting practice. When the external force stops, the ball holder restores to original position. Hence, no additional weight is needed to be added to the base plate. In this manner, the cost is reduce and the practice is more effective.

To achieve the above objects, the present invention includes a sheath tube and a base plate. The sheath tube includes a first segment and a second segment connected to each other. The first segment is a tube with a round cross-section for the insertion of a ball holder. The second segment has the shape of a trumpet. The sheath tube is compressible and resilient. The base plate includes an installation hole of a diameter between the maximum diameter and the minimum diameter of the trumpet-shaped second segment. When assembled, the larger end of the trumpet-shaped of the second segment is compressed into the installation hole so that the sheath tube is tightly fixed to the base plate.

In comparison with the conventional batting practice apparatus, the present invention uses a single sheath tube to engage the ball holder to the base plate to save the manufacturing cost as well as enable convenient assembly and disassembly. In addition, because the trumpet-shaped part of the sheath tube can annihilate a part of the force exerted upon the apparatus during practice, the base plate does not require extra weight to prevent from tipping over.

The foregoing and other objects, features, aspects and advantages of the present invention will become better understood from a careful reading of a detailed description provided herein below with appropriate reference to the accompanying drawings.

BRIEF DESCRIPTION OF THE DRAWINGS

The present invention can be understood in more detail by reading the subsequent detailed description in conjunction with the examples and references made to the accompanying drawings, wherein.

DETAILED DESCRIPTION OF THE PREFERRED EMBODIMENTS

Figure 1:
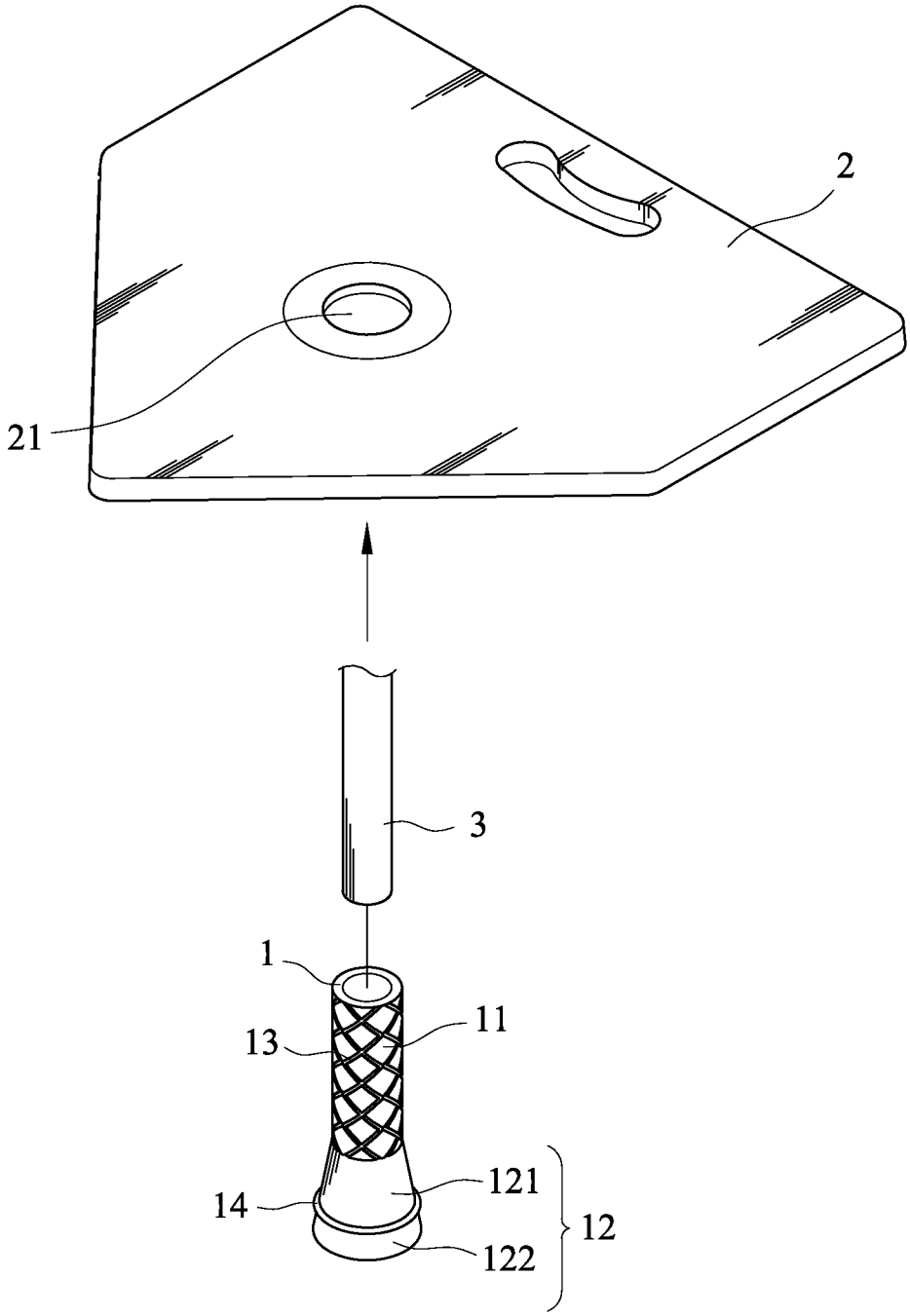
FIG. 1 shows a schematic exploded view according to the present invention.
Figure 2:
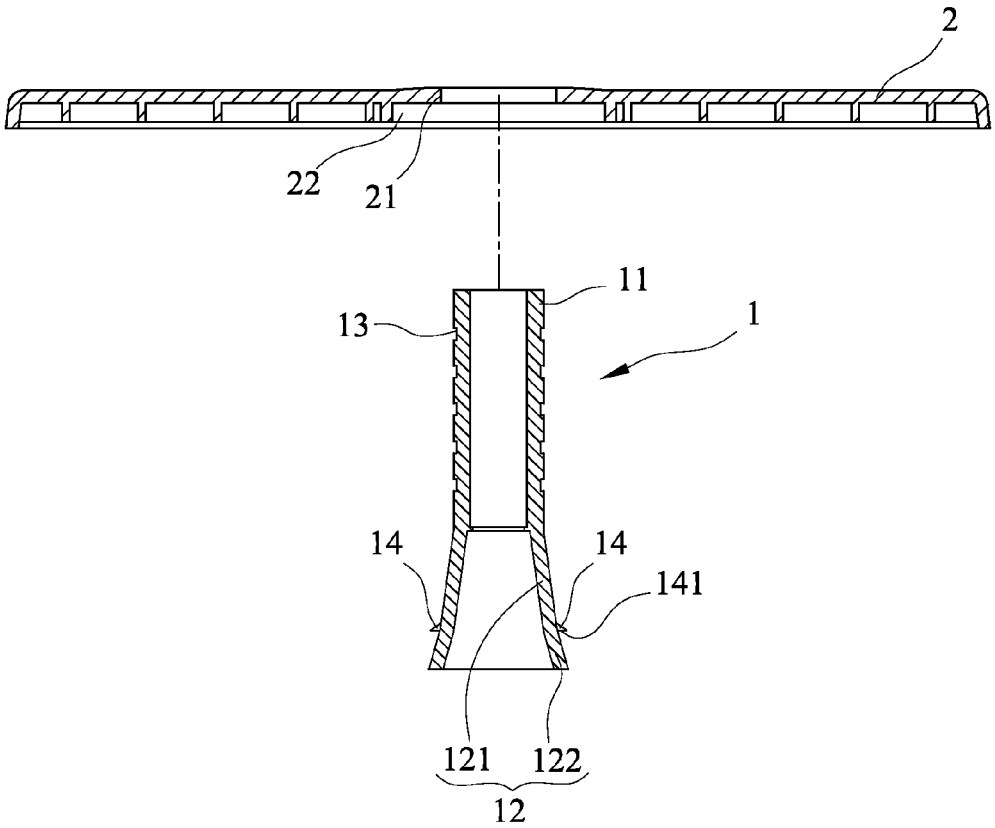
FIG. 2 shows a cross-sectional view according to the present invention.

FIG. 1 and FIG. 2 show an exploded schematic view and a cross-sectional schematic view of the ball holder and base plate fixing structure according to the present invention. The fixing structure is to fix ball holder 3 to base plate 2.

The fixing structure mainly includes a sheath tube 1 and a base plate 2. Sheath tube 1 can be made of resilient and deformable material, such as, rubber. Sheath tube 1 includes a first segment 11 and a second segment 12. First segment 11 and second segment 12 are connected to each other, with first segment 11 on top and second segment 12 at bottom. The cross-section of first segment 11 is round. Second segment 12 has a trumpet shape, that is, one end has a larger diameter than the other end and the diameter increases gradually. The outer wall of first segment 11 includes a plurality of regular plaid-pattern trenches 13 so that the batting force absorbed by sheath tube 1 can be evenly distributed to plaid-pattern trenches 13. In addition, second segment 12 of sheath tube 2 includes a monolithic cone structure having a first conic wall 121 and a second conic wall 122 of different conic angles. The conic angle of first conic wall 121 is greater than the conic angle of second conic wall 122. Therefore, the outer diameter of second conic wall 122 is greater than the outer diameter of first conic wall 121 to prevent sheath tube 2 from slipping from base plate 2 during assembly. The outside of the wall of second segment 12 of sheath tube 1 has a ring of stuck edge 14, preferably located on the outside of first conic wall 121 and close to the junction of second conic wall 122. The structure of stuck edge 14 is a slanted surface expanding outwards formed on the outer wall of second segment 12 of sheath tube 1. As shown in FIG. 2, the cross section of stuck edge 14 shows a triangle with a flat bottom 141. Stuck edge and sheath tube 1 are a monolithic structure. The function of stuck edge 14 is to prevent sheath tube 1 from disengaging from base plate 2, and to fix sheath tube 1 standing stably above base plate 2. Also, the present embodiment shows that stuck edge 14 is a ring distributed outside of first conic wall 121. But the embodiment is only illustrative, not restrictive. Stuck edge 14 can also be a protruding block having a triangular cross section, and the number of stuck edges is at least two so as to be evenly distributed outside of first conic wall 121. The wall thickness of sheath tube 1 must be greater than ⅕ of the diameter of the tube so that sheath tube 1 remains resilient and sufficiently strong under compression.

Base plate 2 is a pentagonal shape. The central area of base plate 2 has an installation hole 21 having a diameter between the minimum and maximum outer diameters of the trumpet-shape wall of second segment 12 of sheath tube 1. The preferred diameter of installation hole 21 is smaller than ½ of the total of the maximum and minimum outer diameters. The bottom of base plate 2 further forms a housing space 22 with the top connected to installation hole 21. When assembled, second conic wall 122 of second segment 12 is located inside housing space 22. The diameter of installation hole 21 is smaller than the maximum diameter of stuck edge 14.

Figure 3:
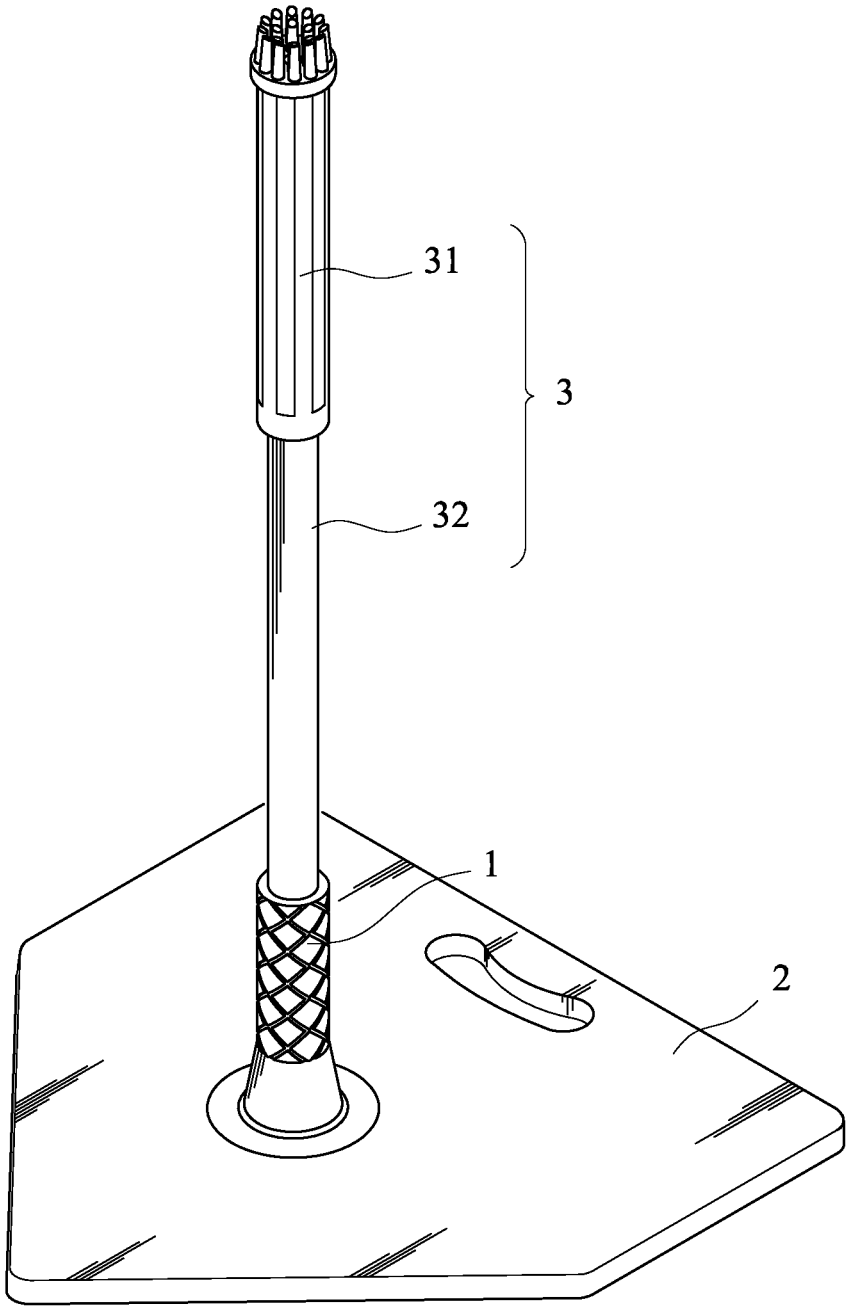
FIG. 3 shows a schematic view of ball holder and fixing structure assembled according to the present invention.
Figure 4:
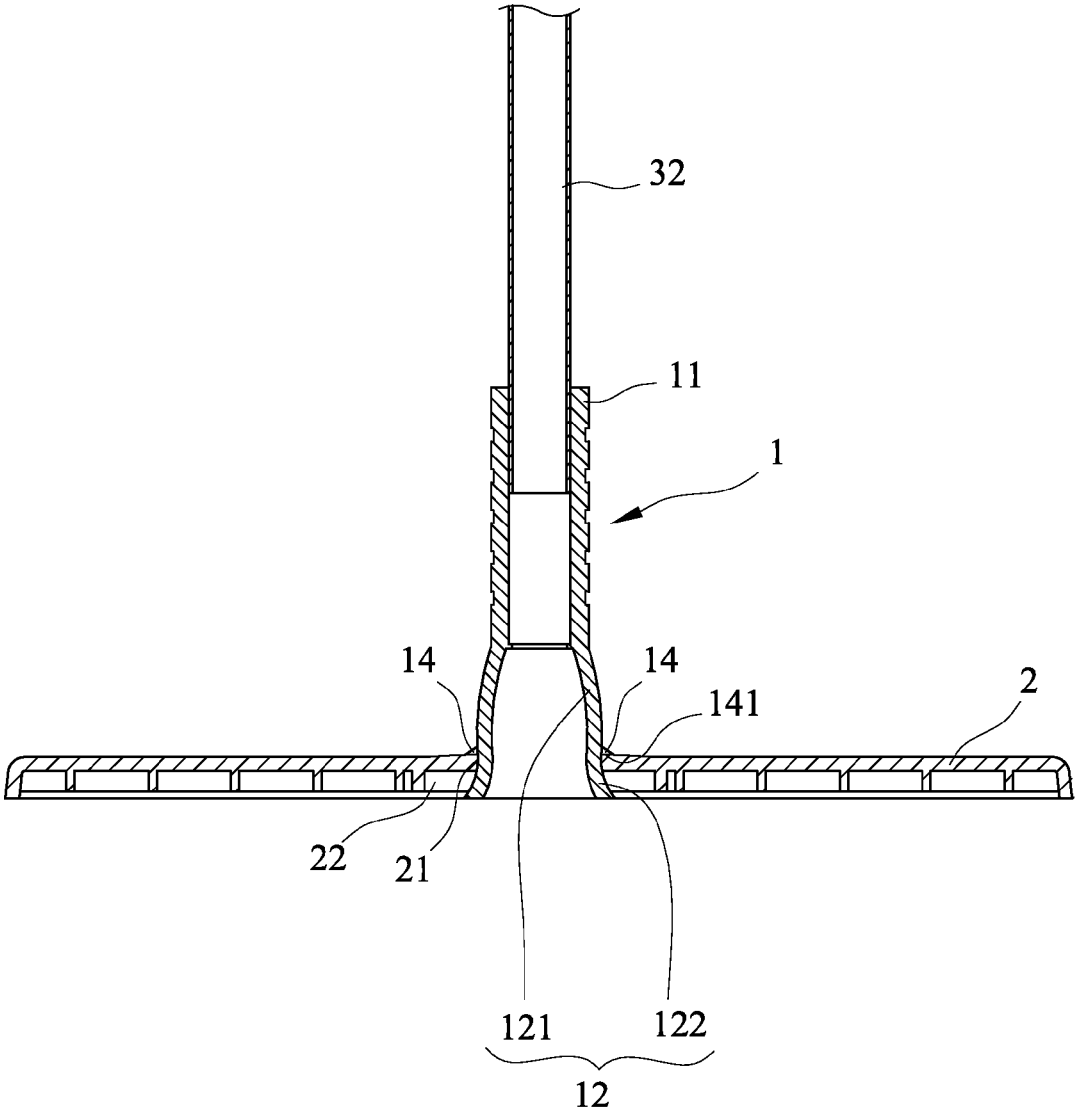
FIG. 4 shows a cross-sectional view of ball holder and fixing structure assembled according to the present invention.

Refer to FIG. 1-FIG. 4. FIG. 3 and FIG. 4 show a schematic assembly view and a schematic assembly cross-section view of the ball holder and base plate fixing structure according to the present invention. The object of ball holder 3 is to provide a tip location for the ball to be placed on. The ball holder can be of different types and shapes. The present invention shows an embodiment for description. Base holder 3 is usually made into a plurality of segments. For example, the present embodiment shows a ball holder 3 having a first connecting rod 31 and a second connecting rod 32, and both can be assembled for batting practice. Sheath tube 1, base plate 2 and ball holder 3 are assembled as follows. First, first connecting rod 31 and second connecting rod 32 are connected, and then first segment 11 of sheath tube 1 penetrate installation hole 21 of base plate 2 from beneath. Because the diameter of installation hole 21 is smaller than the diameter of a partial segment of second segment 12, the resilient material of second segment 12 will be evenly compressed for the penetration. Because the cross section of second segment 12 is a ring, the compression will gradually reduce the diameter of the tube wall so that the outer wall near the junction of first conic wall 121 and second conic wall 122 will be tightly placed inside installation hole 21. In this manner, the original trumpet-shaped (shown in FIG. 2) second segment 12 will become gourd-shaped (as shown in FIG. 4). Gourd-shaped second segment 12 enables the tight engagement of sheath tube 1 to base plate 2. For safety concern, the present invention further make bottom 141 of stuck edge 14 press against the upper surface of base plate 2 surrounding installation hole 21. Because of stuck edge 14, sheath tube 1 cannot not disengage from installation hole 21 in the downward direction. Second conic wall 122 of second segment 12 is located at the lower edge of installation hole 21 to further prevent sheath tube 1 from disengaging from base plate 2 in the upward direction. Finally, second connecting rod 32 is sheathed into first segment 11 of sheath tube 1 to complete the assembly. The present invention uses sheath tube 1 as the engagement element to connect ball holder 3 and base plate 2. By using the compressible resilience of sheath tube 1, the present invention can tightly fix sheath tube 1 to base plate 2. During batting practice, the resilience of sheath tube can also annihilate a part of the force acted on the present invention.

Figure 5:
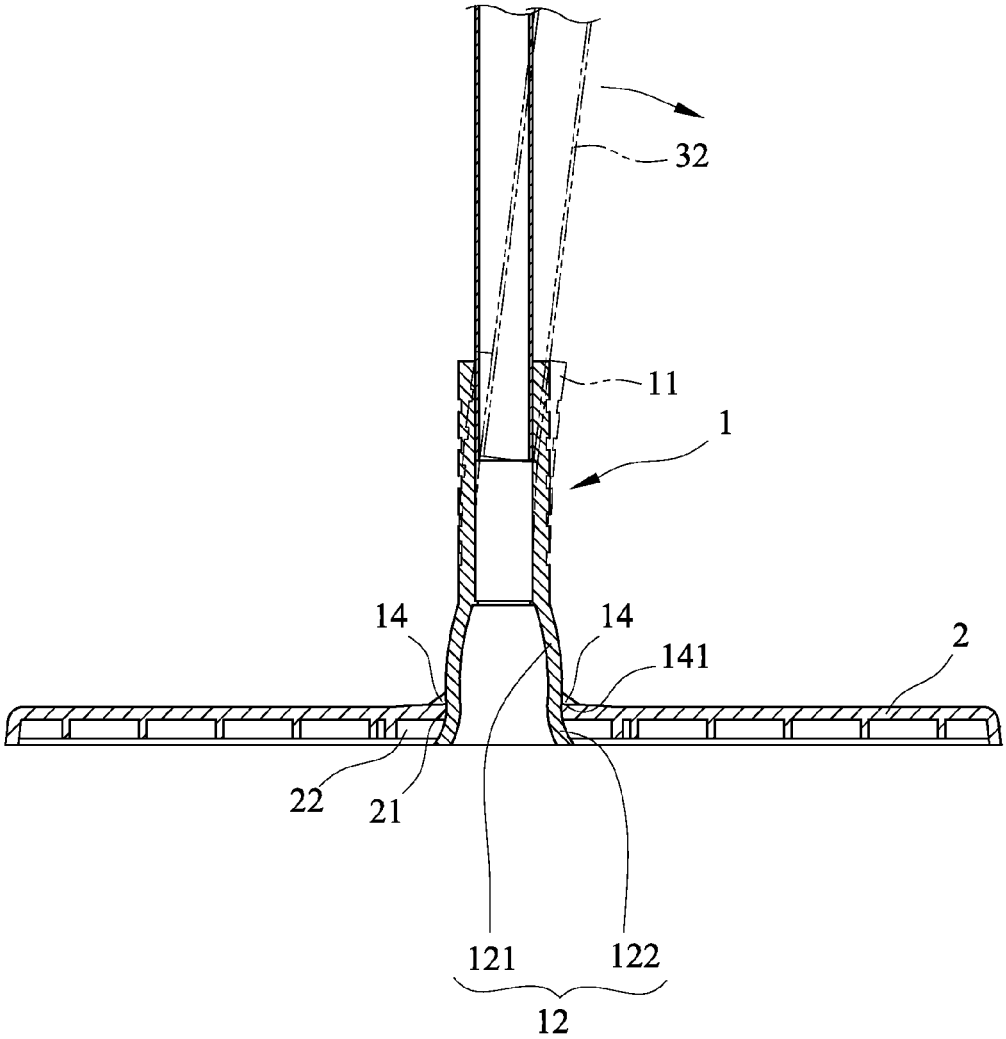
FIG. 5 shows a schematic view of the deformation of the present invention on impact during batting practice.

FIG. 5 shows a schematic view of deformation of the present invention under the impact of batting. When the bat hits ball holder 3, first segment 11 can swing and twist along ball holder 3 because sheath tube 1 has resilience. Sheath tube 1 absorbs some of the impact on ball holder 3 and propagates the impact evenly through the plaid-patterned trenches 13 to prevent the impact from concentrating on any specific location on sheath tube 1. In this manner, the sheath tube has a longer life span. After batting, the resilience of sheath tube 1 will restore ball holder 3 to original position.

Figure 6:
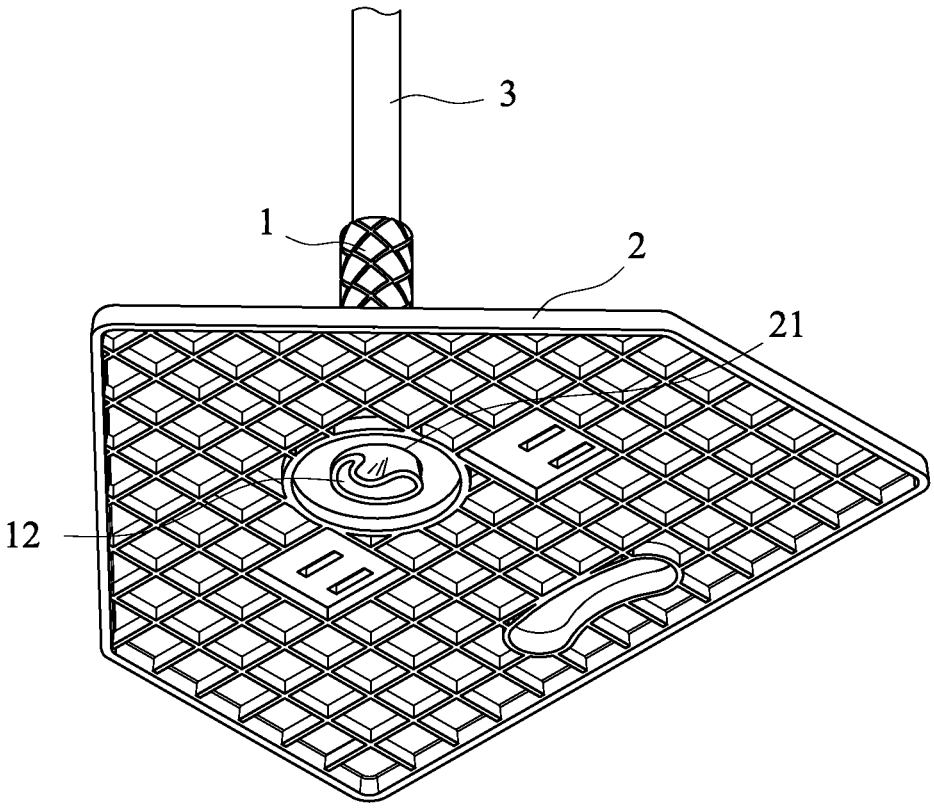
FIG. 6 shows a schematic view of an operation to disengage sheath tube from base plate according to the present invention.
Figure 7:
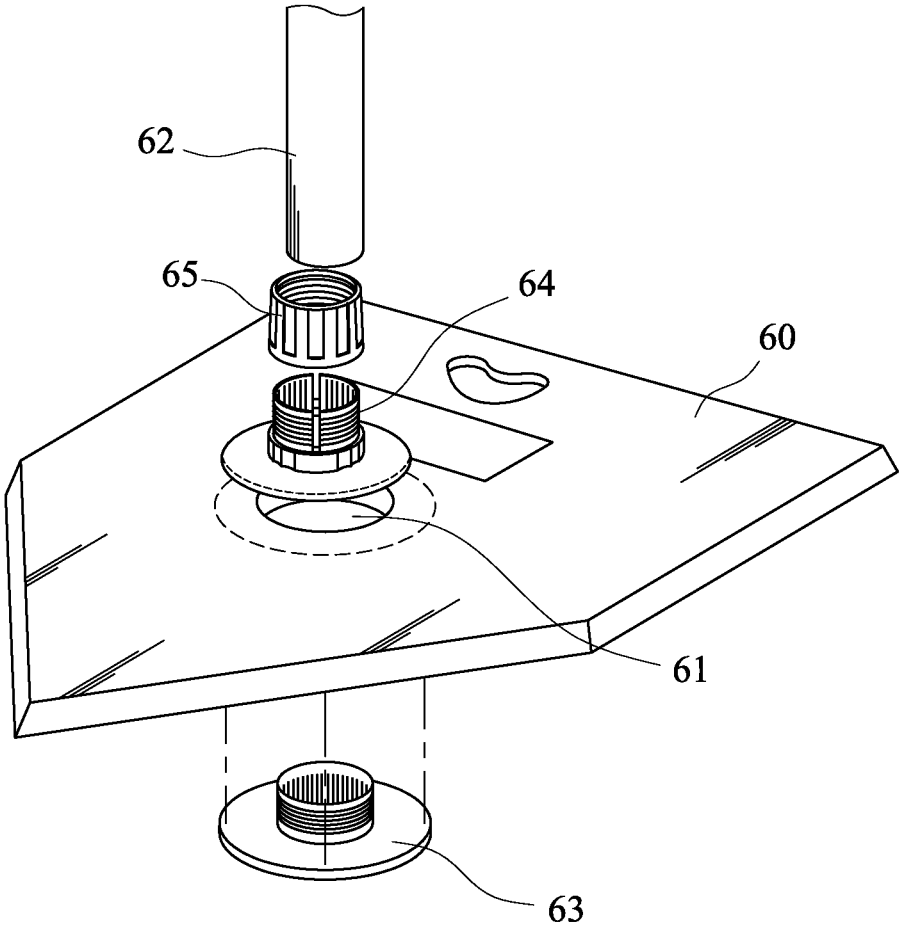
FIG.7 PRIOR ART
FIG. 7 shows a schematic view of a conventional batting practice apparatus.

FIG. 6 shows an operation t disengage the sheath tube from the base plate. Because second segment 12 of sheath tube 1 is originally in the shape of trumpet. If sheath tube 1 is pulled upward, the engagement to installation hole 21 will grow tighter. Therefore, sheath tube 1 cannot be disengaged from installation hole from the upward direction. On the other hand, sheath tube 1 has stuck edge 14 to prevent direct disengagement from installation hole 21 from the downward direction. Therefore, to disengage sheath tube 1 and base plate 2, the operation requires to compress and fold trumpet-shaped second segment 12 into deformation with a smaller volume so that sheath tube 1 can conveniently disengage from installation hole 21.

In comparison with the conventional technique, the present invention does not use locking element to fix the ball holder to the base plate. In this manner, the manufacturing cost is reduced and easy assembly can be made. On the other hand, conventional base plate requires considerable weight to stable the base plate from tipping over upon batting. The present invention employs the trumpet-shaped bottom of sheath tube to absorb the impact so a less weight can be used to balance the apparatus in comparison with the conventional technique.

Although the present invention has been described with reference to the preferred embodiments, it will be understood that the invention is not limited to the details described thereof. Various substitutions and modifications have been suggested in the foregoing description, and others will occur to tube of ordinary skill in the art. Therefore, all such substitutions and modifications are intended to be embraced within the scope of the invention as defined in the appended claims.

What is claimed is:

1. A fixing structure for a batting practice apparatus including a ball holder, the fixing structure comprising:

a monolithic sheath tube having compressible resilience and comprising a first segment and a second segment connected to each other, said second segment having a trumpet shape, said second segment further including a first conic wall and a second conic wall having different conic angles, said first conic wall is connected to said first segment and said first conic wall has a conic angle greater than a conic angle of said second conic wall, an outer wall of said first conic wall including a protruding stuck edge located near a junction between said first conic wall and said second conic wall, said stuck edge is distributed in a ring shape around an outer wall of said second segment, said stuck edge forming a conic surface expanding outward from an outer side of said first conic wall, said stuck edge having a flat bottom, and said stuck edge and said sheath tube are of a monolithic structure; and said batting practice apparatus having a base plate having an installation hole, the installation hole having a diameter between a maximum outer diameter and a minimum outer diameter of said trumpet shape of the second segment, wherein said first segment has a round tube shape for placing said ball holder, wherein when assembled, said second segment is compressed into said installation hole for tight engagement so as to fix said sheath tube to said base plate.

2. The fixing structure as claimed in claim 1, wherein said sheath tube comprises a plurality of plaid-pattern trenches on sides of outer wall of said first segment.

3. The fixing structure as claimed in claim 1, wherein said base plate further comprises a housing space, with a top of said housing space connecting to said installation hole, when assembled, said second conic wall is located inside said housing space.

4. The fixing structure as claimed in claim 1, wherein said sheath tube has a wall thickness greater than ⅕ of a diameter of said sheath tube so as to provide sufficient strength and resilience.

5. A fixing structure for a batting practice apparatus including a ball holder, the fixing structure comprising:

a monolithic sheath tube having compressible resilience and comprising a first segment and a second segment connected to each other, said second segment having a trumpet shape, said second segment further including a first conic wall and a second conic wall having different conic angles, said first conic wall is connected to said first segment and said first conic wall has a conic angle greater than a conic angle of said second conic wall, an outer wall of said first conic wall including a protruding stuck edge located near a junction between said first conic wall and said second conic wall, said stuck edge including at least two protruding blocks on an outer wall of said second segment, the at least two protruding blocks being distributed evenly around said first conic wall; and said batting practice apparatus having a base plate having an installation hole, the installation hole having a diameter between a maximum outer diameter and a minimum outer diameter of said trumpet shape of second segment, wherein said first segment has a round tube shape for placing said ball holder, wherein when assembled, said second segment is compressed into said installation hole for tight engagement so as to fix said sheath tube to said base plate.

6. The fixing structure as claimed in claim 5 wherein said sheath tube comprises a plurality of plaid-pattern trenches on sides of outer wall of said first segment.

7. The fixing structure as claimed in claim 5, wherein said base plate further comprises a housing space, with a top of said housing space connecting to said installation hole, when assembled, said second conic wall is located inside said housing space.

8. The fixing structure as claimed in claim 5, wherein said sheath tube has a wall thickness greater than ⅕ of a diameter of said sheath tube so as to provide sufficient strength and resilience.

9. A fixing structure for a batting practice apparatus including a ball holder, the fixing structure comprising:

a monolithic sheath tube having compressible resilience and comprising a first segment and a second segment connected to each other, said second segment having a trumpet shape, said second segment further including a first conic wall and a second conic wall having different conic angles, said first conic wall is connected to said first segment and said first conic wall has a conic angle greater than a conic angle of said second conic wall, an outer wall of said first conic wall including a protruding stuck edge located near a junction between said first conic wall and said second conic wall; and said batting practice apparatus having a base plate having an installation hole, the installation hole having a diameter between a maximum outer diameter and a minimum outer diameter of said trumpet shape of second segment, wherein said first segment has a round tube shape for placing said ball holder, wherein when assembled, said second segment is compressed into said installation hole for tight engagement so as to fix said sheath tube to said base plate, wherein said stuck edge has a maximum diameter greater than an inner diameter of said installation hole of said base plate, further wherein when assembled, a bottom of said stuck edge presses against a top surface of said base plate that surrounds said installation hole.

10. The fixing structure as claimed in claim 9, wherein said sheath tube comprises a plurality of plaid-pattern trenches on sides of outer wall of said first segment.

11. The fixing structure as claimed in claim 9, wherein said base plate further comprises a housing space, with a top of said housing space connecting to said installation hole, when assembled, said second conic wall is located inside said housing space.

12. The fixing structure as claimed in claim 9, wherein said sheath tube has a wall thickness greater than ⅕ of a diameter of said sheath tube so as to provide sufficient strength and resilience.

* * * * *